US007414338B2

(12) United States Patent
Endo et al.

(10) Patent No.: US 7,414,338 B2
(45) Date of Patent: Aug. 19, 2008

(54) ELECTRIC ROTATING MACHINE CAPABLE OF REDUCING PERFORMANCE DETERIORATION DUE TO DISCHARGE

(75) Inventors: Yasuhiro Endo, Toyota (JP); Ryoji Mizutani, Nishikamo-gun (JP); Hitoshi Oyama, Osaka (JP); Shinichi Iiduka, Osaka (JP)

(73) Assignees: Toyota Jidosha Kabushiki Kaisha, Toyota (JP); Sumitomo Electric Industries, Ltd., Osaka (JP)

( * ) Notice: Subject to any disclaimer, the term of this patent is extended or adjusted under 35 U.S.C. 154(b) by 536 days.

(21) Appl. No.: 10/943,990

(22) Filed: Sep. 20, 2004

(65) Prior Publication Data

US 2005/0135949 A1 Jun. 23, 2005

(30) Foreign Application Priority Data

Dec. 19, 2003 (JP) ..... 2003-422056

(51) Int. Cl.
*H02K 9/00* (2006.01)

(52) U.S. Cl. ..... 310/52; 310/54

(58) Field of Classification Search ..... 417/423.13, 417/321–410.5; 310/54, 52
See application file for complete search history.

(56) References Cited

U.S. PATENT DOCUMENTS 2,975,309 A * 3/1961 Seidner ..... 310/54
4,545,743 A * 10/1985 Earley ..... 417/372
4,569,639 A * 2/1986 Hannibal et al. ..... 417/368
5,087,382 A 2/1992 Ishino et al.
5,454,724 A * 10/1995 Kloeppel et al. ..... 439/17
5,661,353 A * 8/1997 Erdman et al. ..... 310/86
6,011,338 A * 1/2000 Bell et al. ..... 310/184
6,069,431 A * 5/2000 Satoh et al. ..... 310/260
6,216,476 B1 * 4/2001 Numoto et al. ..... 62/114
6,686,673 B1 * 2/2004 Komura et al. ..... 310/90
2002/0057971 A1 * 5/2002 Shida et al. ..... 417/410.1
2002/0063487 A1 * 5/2002 Leijon ..... 310/179

FOREIGN PATENT DOCUMENTS

JP A 4-15295 1/1992
JP A 8-261152 10/1996
JP 11318055 A * 11/1999
JP A 2001-139971 5/2001
JP A 2002-147477 5/2002

* cited by examiner

*Primary Examiner*—Darren Schuberg
*Assistant Examiner*—Alex W Mok
(74) *Attorney, Agent, or Firm*—Oliff & Berridge, PLC

(57) ABSTRACT

An electric rotating machine includes a case, a stator, a rotor and an oil. The stator is comprised of a stator core and a coil. The oil has a volume resistivity ranging from $10^2$ to $10^9$ Ωcm and is reserved in a bottom part of the case. The coil is partially immersed in the oil.

5 Claims, 2 Drawing Sheets

ELECTRIC ROTATING MACHINE CAPABLE OF REDUCING PERFORMANCE DETERIORATION DUE TO DISCHARGE

This nonprovisional application is based on Japanese Patent Application No. 2003-422056 filed with the Japan Patent Office on Dec. 19, 2003, the entire, contents of which are hereby incorporated by reference.

BACKGROUND OF THE INVENTION

1. Field of the Invention

The present invention relates to an electric rotating machine, and particularly to an electric rotating machine using an oil with which deterioration in insulation performance due to discharge can be reduced.

2. Description of the Background Art

Japanese Patent Laying-Open No. 8-261152 discloses an electrically-driven compressor of hermetically-sealed type. This electrically-driven sealed-type compressor includes a sealed vessel, a stator, a rotor, a crankshaft, and a lubricating oil. The lubricating oil is stored in a bottom part of the sealed vessel. One end of the crankshaft is immersed in the lubricating oil.

The rotor is fixed to the crankshaft. The stator is provided around the periphery of the rotor. The stator includes a coil, and one of the two coil-ends of the coil is in contact with the lubricating oil.

The crankshaft has a hollow structure. A pump member for raising the lubricating oil is contained in the hollow inner part of the end of the crankshaft that is immersed in the lubricating oil. The pump member thus raises the lubricating oil by rotations of the crankshaft. The lubricating oil raised by the pump member is lifted through the crankshaft by centrifugal force generated by the rotations.

The lifted lubricating oil is applied, in the form of drops, through a hole in the other end of the crankshaft to cool a coil end of the stator for example and returned to the bottom part of the sealed vessel.

With the electrically-driven sealed-type compressor, as discussed above, the lubricating oil stored in the bottom part of the sealed vessel is circulated to cool the coil end for example.

When the lubricating oil is used for cooling the coil end, however, a difference in dielectric constant between an insulating material covering the coil and the lubricating oil causes intermittent changes in electric-field intensity, resulting in discharge on the interface therebetween to possibly cause damage to the insulating material.

SUMMARY OF THE INVENTION

An object of the present invention is thus to provide an electric rotating machine using an oil with which deterioration in insulation performance due to discharge can be reduced.

According to the present invention, an electric rotating machine includes an oil, a stator and a rotor. The stator is covered with an insulating material and includes a coil partially immersed in the oil. The rotor is provided rotatably with respect to the stator. The oil includes an electrically-conducting material for reducing discharge caused by a difference in dielectric constant between the oil and the insulating material.

Preferably, the oil has a volume resistivity of electrically semiconducting property in a normal temperature region.

Preferably, the volume resistivity is selected to smooth the difference in dielectric constant between the oil and the insulating material.

Preferably, the volume resistivity ranges from $10^2$ to $10^9$ Ωcm.

Preferably, the oil includes, as the electrically-conducting material, carbon black with its particle size ranging from 10 to 50 nm.

The electric rotating machine of the present invention has the stator coil that is partially immersed in the oil. The oil thus reduces discharge due to a difference in dielectric constant between the oil and the insulating material covering the coil.

The present invention can accordingly prevent any damage due to the discharge of the insulating material covering the coil. For the electric rotating machine, deterioration in insulation performance due to discharge can thus be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
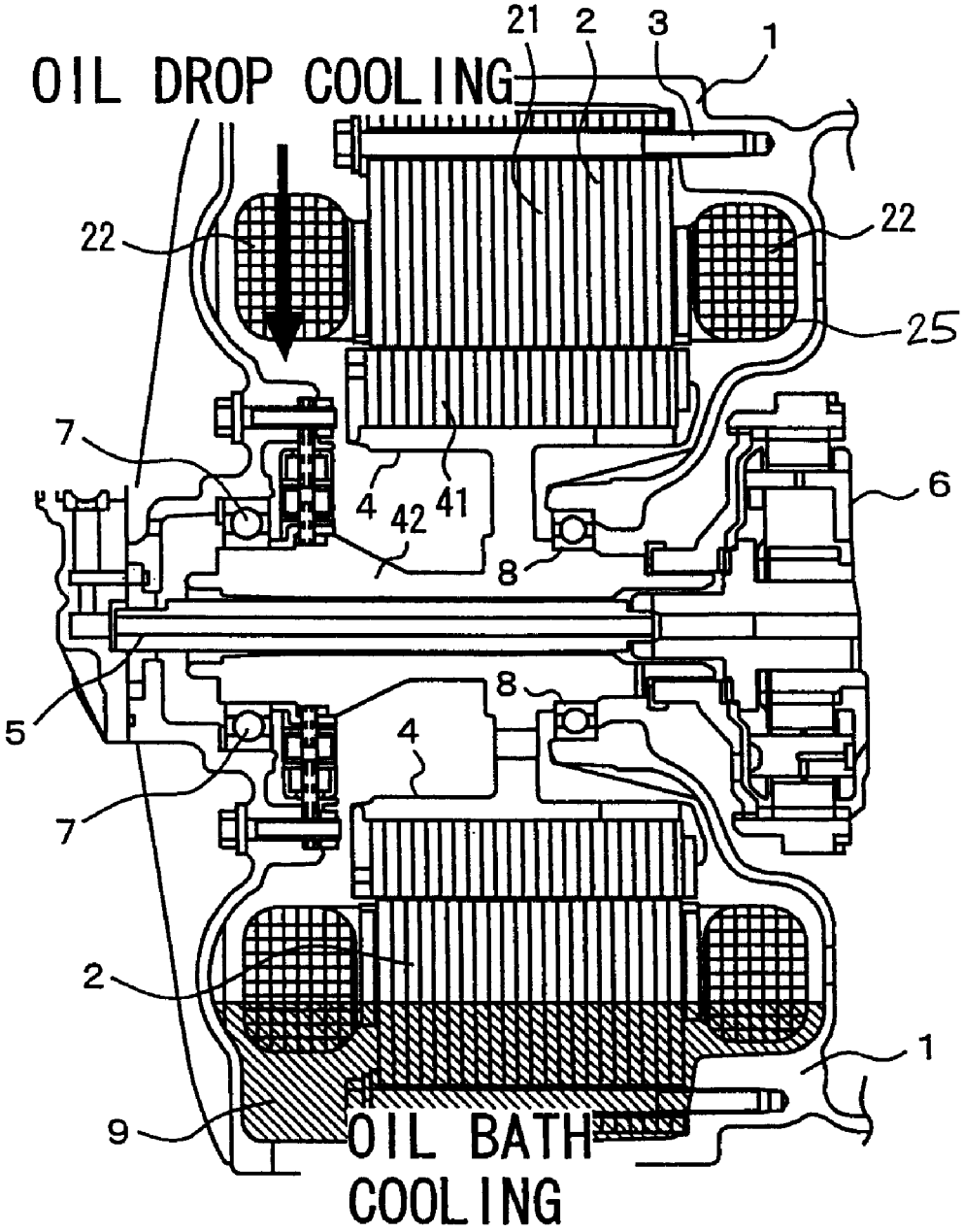
FIG. 1 is a schematic cross-sectional view of an electric rotating machine according to an embodiment of the present invention.

An embodiment of the present invention is now described in detail with reference to the drawings. It is noted here that like components in the drawing are denoted by like reference characters and the description thereof is not repeated.

FIG. 1 is a schematic cross-sectional view of an electric rotating machine according to this embodiment of the present invention. Referring to FIG. 1, electric rotating machine 100 of the present invention includes a case 1, a stator 2, a rotor 4, a crankshaft 5, a coupling portion 6 and an oil 9.

Stator 2 includes a stator core 21 and a coil 22. Coil 22 is wound around stator core 21. Stator core 21 is fixed to case 1 with a screw 3. Stator 2 is accordingly fixed to case 1.

Rotor 4 is placed in the inner periphery of stator 2. Rotor 4 includes a rotor core 41 and a rotor shaft 42. Rotor core 41 is placed to face stator core 21. Rotor shaft 42 holds rotor core 41. Rotor shaft 42 has its inner end which is spline-meshed with crankshaft 5.

Rotor shaft 42 spline-meshed with crankshaft 5 is rotatably supported by bearings 7 and 8. One end of crankshaft 5 is connected to coupling portion 6 to transmit torque generated by rotations of rotor 4 to coupling portion 6.

Coupling portion 6 connects crankshaft 5 via a clutch to drive wheels to transmit the torque generated by rotations of rotor 4 to the drive wheels.

Oil 9 is reserved in a bottom part of case 1. A part of stator 2 is immersed in oil 9. In other words, coil 22 of stator 2 is partially immersed in oil 9.

Oil 9 contains approximately 5 to 50% by weight of carbon black with the particle size ranging from 10 to 50 nm. Oil 9 thus has a volume resistivity ranging from $10^2$ to $10^9$ Ωcm in a normal temperature region. In other words, oil 9 has electrically semiconducting property.

Figure 2:
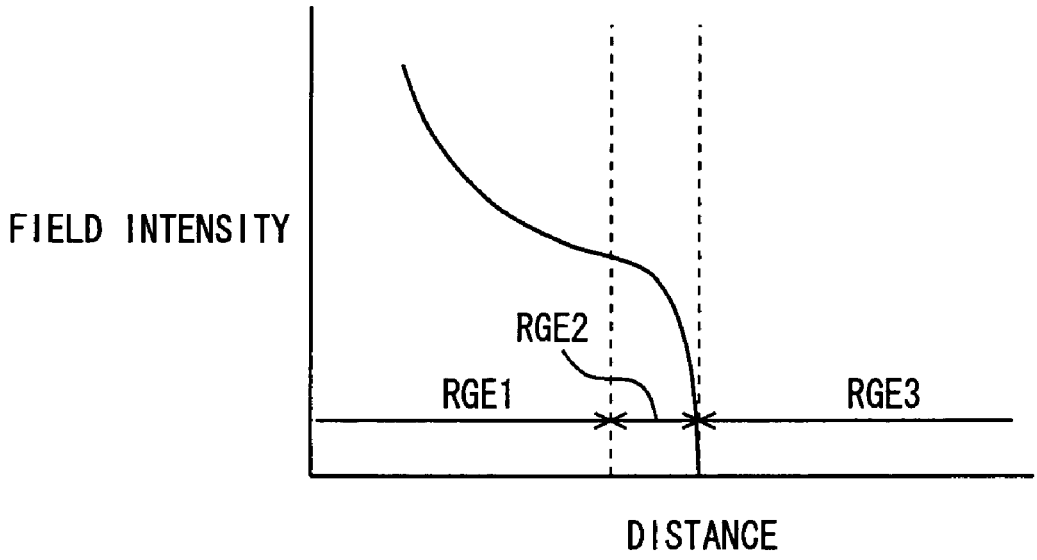
FIG. 2 shows a field-intensity distribution when an oil of the present invention is used.
Figure 3:
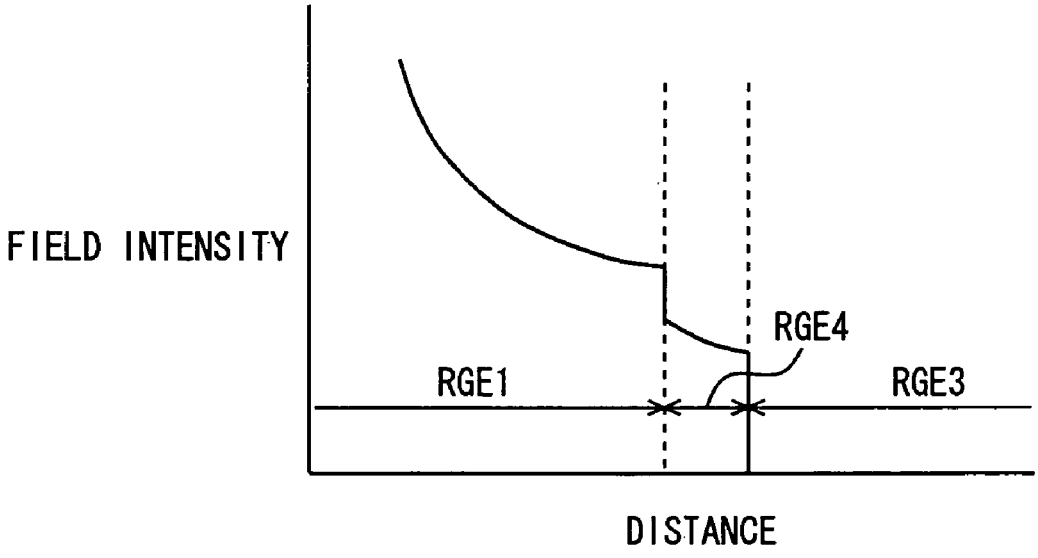
FIG. 3 shows a field-intensity distribution when a conventional oil is used.

FIG. 2 shows a field-intensity distribution when the oil of the embodiment of the present invention is used. FIG. 3 shows a field-intensity distribution when a conventional oil is used. In FIGS. 2 and 3, the horizontal axis represents distance and the vertical axis represents field intensity. Further, a region RGE1 represents the region of an insulating material 25 covering coil 22 of stator 2 and a region RGE3 represents the region of the air. A region RGE2 in FIG. 2 represents the region of oil 9 and a region RGE4 in FIG. 3 represents the region of the lubricating oil. The lubricating oil contains no carbon black unlike oil 9 and has a volume resistivity higher than $10^9$ Ωcm.

For the lubricating oil, the field intensity abruptly changes on the boundary between region RGE1 of the insulating material and region RGE4 of the lubricating oil as well as on the boundary between region RGE4 of the lubricating oil and region RGE3 of the air. Consequently, discharge is likely to occur on the boundary between region RGE4 of the lubricating oil and region RGE3 of the air.

In contrast, when oil 9 having the electrically semiconducting property is used, the field intensity does not abruptly change but is smoothed on the boundary between region RGE1 of the insulating material and region RGE2 of oil 9 as well as on the boundary between region RGE2 of oil 9 and region RGE3 of the air. Thus, discharge is unlikely to occur between the insulating material covering coil 22 and oil 9 so that deterioration in insulation performance of coil 22 can be reduced.

As discussed above, oil 9 has the volume resistivity ranging from $10^2$ to $10^9$ Ωcm. The volume resistivity of $10^2$ Ωcm and that of $10^9$ Ωcm are the lower limit and the upper limit respectively of the volume resistivity that do not cause discharge between oil 9 and the air. In other words, the lower limit corresponds to the volume resistivity with which oil 9 exhibits electrical property of a conductor when the volume resistivity further decreases, and the upper limit corresponds to the volume resistivity with which oil 9 exhibits electrical property of an insulator when the volume resistivity further increases.

When oil 9 assumes electrical property of a conductor or insulator, the field intensity sharply changes on the boundary between the insulating material for coil 22 and oil 9 and on the boundary between oil 9 and the air. Accordingly, in order to reduce the sharp change in field intensity on the boundary between the insulating material for coil 22 and oil 9 and on the boundary between oil 9 and the air, the volume resistivity of oil 9 is set in the range of $10^2$ to $10^9$ Ωcm.

Then, as shown in FIG. 2, the field intensity is smoothed in region RGE2 of oil 9. The sharp change of the field intensity is caused by the difference in dielectric constant between oil 9 and the insulating material which covers coil 22. Therefore, the volume resistivity ranging from $10^2$ to $10^9$ Ωcm corresponds to the volume resistivity that smoothes the difference in dielectric constant between oil 9 and the insulating material. According to the present invention, the volume resistivity of oil 9 is set to the volume resistivity that smoothes the difference in dielectric constant between oil 9 and the insulating material.

In order to set the volume resistivity of oil 9 to the volume resistivity that smoothes the difference in dielectric constant between oil 9 and the insulating material, carbon black with the particle size ranging from 10 to 50 nm is contained in the oil.

The carbon black is an electrically-conductive material for reducing occurrence of discharge caused in the oil having the volume resistivity higher than the volume resistivity of $10^9$ Ωcm. In other words, the carbon black is an electrically-conductive material for reducing discharge due to the difference in dielectric constant between the oil and the insulating material.

Oil 9 thus contains the carbon black for reducing discharge due to the difference in dielectric constant between the oil and the insulating material to prevent any damage to the insulating material which covers coil 22.

As the electrically-conductive material for reducing discharge due to the difference in dielectric constant between the oil and the insulating material, such powder as metal powder or powder of a semiconductor may be used instead of the carbon black.

Referring back to FIG. 1, when alternating current is supplied from an inverter (not shown) to coil 22 of stator 2, stator 2 generates a rotating magnetic field to apply the magnetic field to magnets (not shown) of rotor 4. Then, rotor 4 is rotated by the magnetic interaction between the rotating magnetic field and the magnets to output a predetermined torque.

The predetermined torque generated by rotor 4 is transmitted via crankshaft 5 to coupling portion 6. Coupling portion 6 transmits the torque provided via crankshaft 5 to the drive wheels via the clutch to drive the drive wheels.

Oil 9 reserved in the bottom part of case 1 is supplied via an oil path (not shown) to an upper portion of electric rotating machine 100 and supplied from the rear side of stator 2 to coil 22. Oil 9 is caused to fall by the gravity to cool coil 22 and lubricate the gear and the clutch included in coupling portion 6 as well as bearings 7 and 8. Oil 9 is thereafter returned to and stored again in the bottom part of case 1.

In this way, oil 9 cools coil 22 and lubricates the gear and the clutch included in coupling portion 6 as well as bearings 7 and 8 while circulating within electric rotating machine 100.

When electric rotating machine 100 is operating, oil 9 smoothes the field intensity between region RGE1 of the insulating material which covers coil 22 and region RGE3 of the air to reduce occurrence of discharge and prevent any damage to the insulating material. It is thus achieved to reduce deterioration in insulation performance that is caused by the discharge in the electric rotating machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electric rotating machine comprising:

an oil;

a stator including a coil covered with an insulating material and partially immersed in said oil; and a rotor provided rotatably with respect to said stator, said oil including an electrically-conducting material for reducing discharge caused by a difference in dielectric constant between said oil and said insulating material.

2. The electric rotating machine according to claim 1, wherein said oil has a volume resistivity of electrically semiconducting property in a normal temperature region.

3. The electric rotating machine according to claim 2, wherein said volume resistivity is selected to smooth the difference in dielectric constant between said oil and said insulating material.

4. The electric rotating machine according to claim 3, wherein said volume resistivity ranges from $10^2$ to $10^9$ Ωcm.

5. The electric rotating machine according to claim 3, wherein said oil includes, as said electrically-conducting material, carbon black with its particle size ranging from 10 to 50 nm.

* * * * *